US006073523A

United States Patent [19]

Shinjo

[11] Patent Number: 6,073,523

[45] Date of Patent: Jun. 13, 2000

[54] SCREW-DRIVING APPARATUS

[75] Inventor: Katsumi Shinjo, Osaka, Japan

[73] Assignee: Yugenkaisha Shinjo Seisakusho, Osaka, Japan

[21] Appl. No.: 09/257,493

[22] Filed: Feb. 25, 1999

[30] Foreign Application Priority Data

Apr. 6, 1998 [JP] Japan ..... 10-111554

[51] Int. Cl.[7] ..... B25B 23/04

[52] U.S. Cl. ..... 81/434; 227/136

[58] Field of Search ..... 81/57.37, 433–435; 227/136

[56] References Cited

U.S. PATENT DOCUMENTS

| | | | |
|---|---|---|---|
| 4,988,026 | 1/1991 | Reckelhoff et al. | 81/434 |
| 5,138,913 | 8/1992 | Chen | 81/434 |
| 5,284,074 | 2/1994 | Chen . | |
| 5,402,695 | 4/1995 | Hornung | 81/434 |
| 5,671,645 | 9/1997 | Murayama et al. | 81/434 |
| 5,904,079 | 5/1999 | Tsuge et al. | 81/434 |

*Primary Examiner*—D. S. Meislin

*Attorney, Agent, or Firm*—Antonelli, Terry, Stout & Kraus, LLP

[57] ABSTRACT

A screw-driving apparatus has a sprocket (21) causing the belt (70) to intermittently advance, and the sprocket is rotatably held on a transverse shaft (26) supported in a side wall of a slider (2) perpendicularly to a driver bit (7). The sprocket (21) is driven by a ratchet wheel (22) rotated by a pawl (24) swingably connected to a bell crank (23), the ratchet wheel (22) coaxial with the sprocket rotating only in one direction along with the sprocket. The bell crank (23) located near the sprocket is rockably held on the slider (2) and its one arm normally protrudes upwards to engage with a shoulder (35) formed in an upper wall of a casing (1), and the pawl (24) is pivoted to the bell crank's other arm. A spring means (33) always biases the pawl to engage with the ratchet wheel (22), so that as the slider (2) is forced back into the casing (1), the shoulder (35) pushes rotates the bell crank (23) and consequently the pawl (24) and the ratchet wheel make the belt (70) advance one pitch, such that the apparatus has a belt feeding mechanism (20) improved to render it smaller in size, lighter in weight and more convenient to use.

5 Claims, 8 Drawing Sheets

SCREW-DRIVING APPARATUS

BACKGROUND OF THE INVENTION

1. Field of the Invention

The present invention relates to an apparatus that is designed for detachable attachment to a screw driver so as to successively feed screws thereto one by one, wherein the screws are held in a row and along a screw-carrying belt. Particularly, a mechanism for intermittent and regular feed of the screws will be so improved that the apparatus is rendered smaller in size, lighter in weight and more convenient to use.

2. Prior Art

Each apparatus of this kind usually has a cylindrical casing to be mounted on the distal end of an electrically-actuated screw driver, and a slider fitted in and reciprocating fore and aft in the cylinder. A coiled spring is also disposed in the cylinder so as to urge always the slider forwards and towards its home position. A screw feeding mechanism incorporated in the apparatus is of such a structure that a screw-carrying belt will be caused to intermittently advance through and relative to the apparatus. The belt will move in a direction perpendicular to said apparatus, and intermittently by a pitch at which the screws are held on the screw-carrying belt. In use, the slider will be pressed at first against an article into which the screws have to be screwed and fastened. Due to and subsequent to this initial step, the slider will be forced back deeper into the casing against the spring, thereby actuating the belt feeding mechanism to cause the belt to advance one pitch. Thereafter, the driver bit of the electric driver will immediately start to screw into the article the screw which has just been brought into alignment with the driver bit.

In general, the screw-carrying belts used in connection with the described screw-driving apparatuses do each comprise two series of cutouts formed along both the opposite lateral sides of the elongate belt. The cutouts are located at the same pitch as that at which the screws are held on said belt at regular intervals. Corresponding to these intervals, a pair of drive sprockets have a set of teeth that arranged around each of them to engage with those cutouts so as to drive the belt linearly. Since the shafts of those drive sprockets must not interfere with the driver bit, they have had to be offset sideways therefrom (for instance, "up or down" as seen in FIG. 1) or to be bored longitudinally of those shafts. In any case, such prior art apparatuses have been much complicated in structure.

A proposal made probably in view of these drawbacks is disclosed in the specification of the U.S. Pat. No. 5,284,074 as shown in FIGS. 10 and 11. This apparatus provides a mechanism whose single sprocket 103 engages with only one row of cutouts 73 that are formed in and along one lateral side of a screw-carrying belt 70. A drive shaft 104 of such a sprocket 103 extends in parallel with a driver bit 107 so that not only a slider 102 but also a cylindrical casing 101 therefor are enlarged and thus the apparatus would comparatively be rendered less convenient to manually operate. An elongate cam groove 105 with which a sliding pin 106 protruding from the casing 101 engage is formed in the shaft 104 so as to cause the sprocket 103 to intermittently rotate. Such a drive shaft however tends to be worn out soon, in particular in a case wherein it is made of aluminum for making lighter in weight the apparatus. If a hardened steel is used to form the shaft 104, then the apparatus will become heavier and less easy to operate.

SUMMARY OF THE INVENTION

The present invention was made in view of the described drawbacks or inconvenience inherent in the prior art apparatuses or inherent in the prior proposal. Thus, a primary object of the present invention is to provide a novel type of screw-driving apparatus whose mechanism for feeding a screw-carrying belt will comprise a single sprocket for moving the belt so that a slider carrying the single sprocket is not only small enough for the apparatus to be rendered compact, lighter and easy to use, but also can operate smoothly without any trouble. A further object is to provide a screw-driving apparatus with such an improved slider which need not be changed in its overall dimension or size even where a larger sprocket is employed to match an increased pitch at which the screws are arranged along the belt.

In order to achieve the objects, a screw-driving apparatus provided herein does comprise a cylindrical casing to be connected to a distal end of a screw driver, a slider whose proximal region normally is fitted in the casing, the slider having a distal region normally protruding from a distal end of the casing, and a return spring always urging the slider towards a normal position thereof. A belt feeding mechanism that is built in the slider and has a sprocket for causing a screw-carrying belt to move towards a screw-driving station by one pitch every time when the slider is retracted back into the casing against the return spring and due to a reaction of an article to which a distal end of the slider is pressed. Screws are arranged on the belt at regular intervals each equal to the pitch, whereby the screw having just reached the station will be driven by a driver bit of the screw driver into the article in the same manner as in the prior art apparatuses. However, the apparatus of the present invention is characterized in that the sprocket causing the belt to intermittently advance one pitch by one pitch is rotatably held on a transverse shaft that is supported in a side wall of the slider and lying in a direction perpendicular to the driver bit, and the sprocket is driven by a ratchet wheel which in turn is rotated by a pawl swingably connected to a bell crank. In detail, the ratchet wheel is coaxial with the sprocket and capable of rotating only in one angular direction in unison with the sprocket, and the bell crank located near the sprocket and terminating short thereof is rockably held on the side wall of the slider so that one arm of the bell crank has an end normally protruding upwards and capable of engaging with a shoulder that is formed in an upper wall of the casing. The pawl is pivoted to an end of the bell crank's other arm in such a state that a spring means always biases the pawl to engage with a periphery of the ratchet wheel. In operation, as the slider is forced back into the casing, the shoulder thereof will push the one end of the bell crank so that the pawl and the ratchet wheel are activated to make the belt advance intermittently by one pitch.

Preferably, a roller may be attached to the bell crank's one end normally protruding up from the slider so that the casing's shoulder will contact said crank at the roller thereof.

It also is preferable that a passage for guiding the screw-carrying belt is formed in and through the distal end of the slider vertically (in a direction perpendicular to the sprocket's shaft), and an adapter whose position is capable of being changed longitudinally of the casing and in response to length of the screws being used may be fixed on another side wall opposite to that which bears the belt feeding mechanism. This adapter will be adjusted to protrude a suitable distance from the distal end of the slider, corresponding to the screws' length.

Desirably, a rod-shaped stopper penetrates the slider and is reversible "left-side right" so as to change its rearward extension towards the proximal end of the casing, thus realizing any desired effective stroke of the driver bit for fastening each screw.

THE PREFERRED EMBODIMENTS

Figure 1:
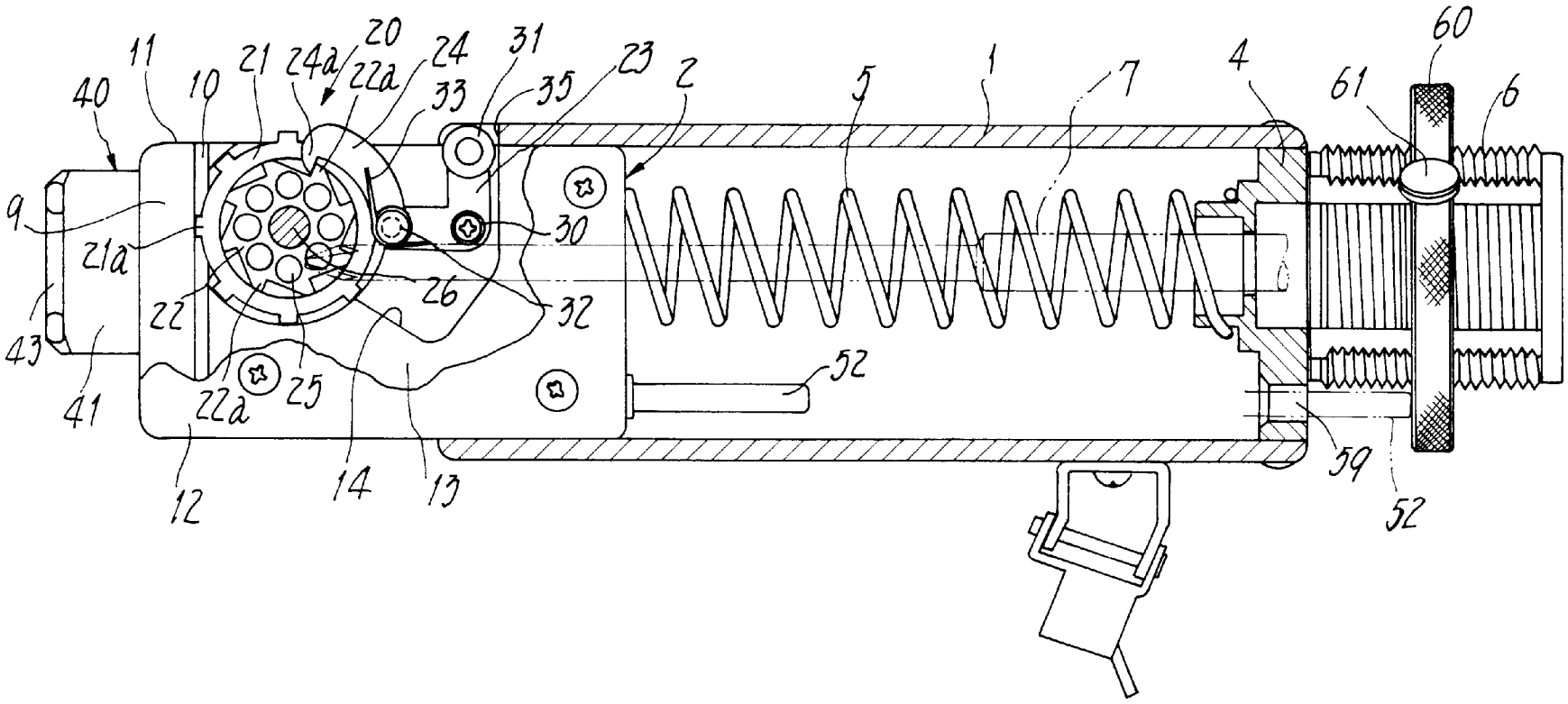
FIG. 1 is a front elevation of a screw-driving apparatus provided herein and shown partly in cross section.
Figure 2:
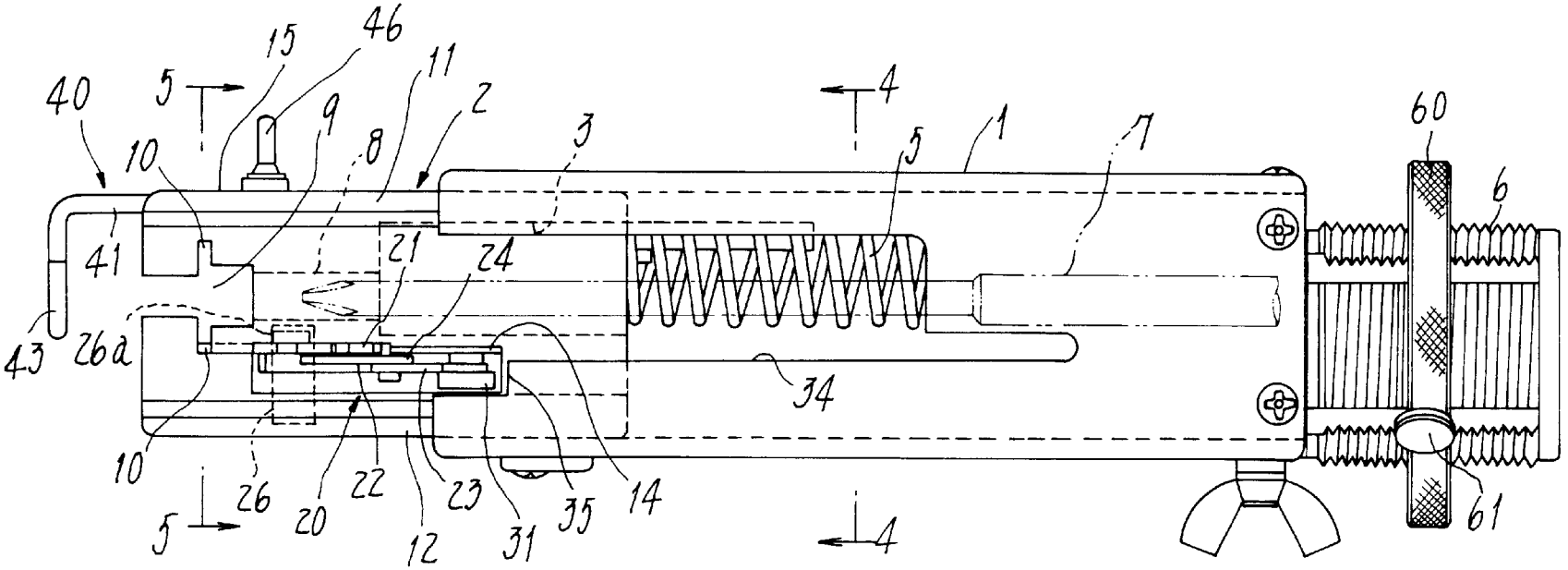
FIG. 2 is a plan view of the apparatus.

A preferable embodiment will be described in detail referring to the drawings. As shown in FIGS. 1 and 2, the screw-driving apparatus provided herein comprises a cylindrical casing 1 and a slider 2 that is slidably fitted therein. A hole 3 formed in a proximal end of the slider 2 serves as a seat for a return spring 5, whose another end abuts against a lid 4 closing a proximal opening of the casing 1. Thus, the spring 5 always urges the slider forwards to normally take a position protruding from a distal end of the slider. In use, a round cylinder 6 secured to the lid 4 and extending outwardly thereof will operatively be connected to an electrically actuated screw driver (not shown). A driver bit 7 of the driver will extend through the lid 4, the hole 3 and a small-diameter bore 8 continuing therefrom (see FIG. 2) so that a distal end of the driver bit is located near a passage 9 formed in the distal end of the slider 2 and guiding a screw-carrying belt 70 (see FIG. 5).

Figure 5:
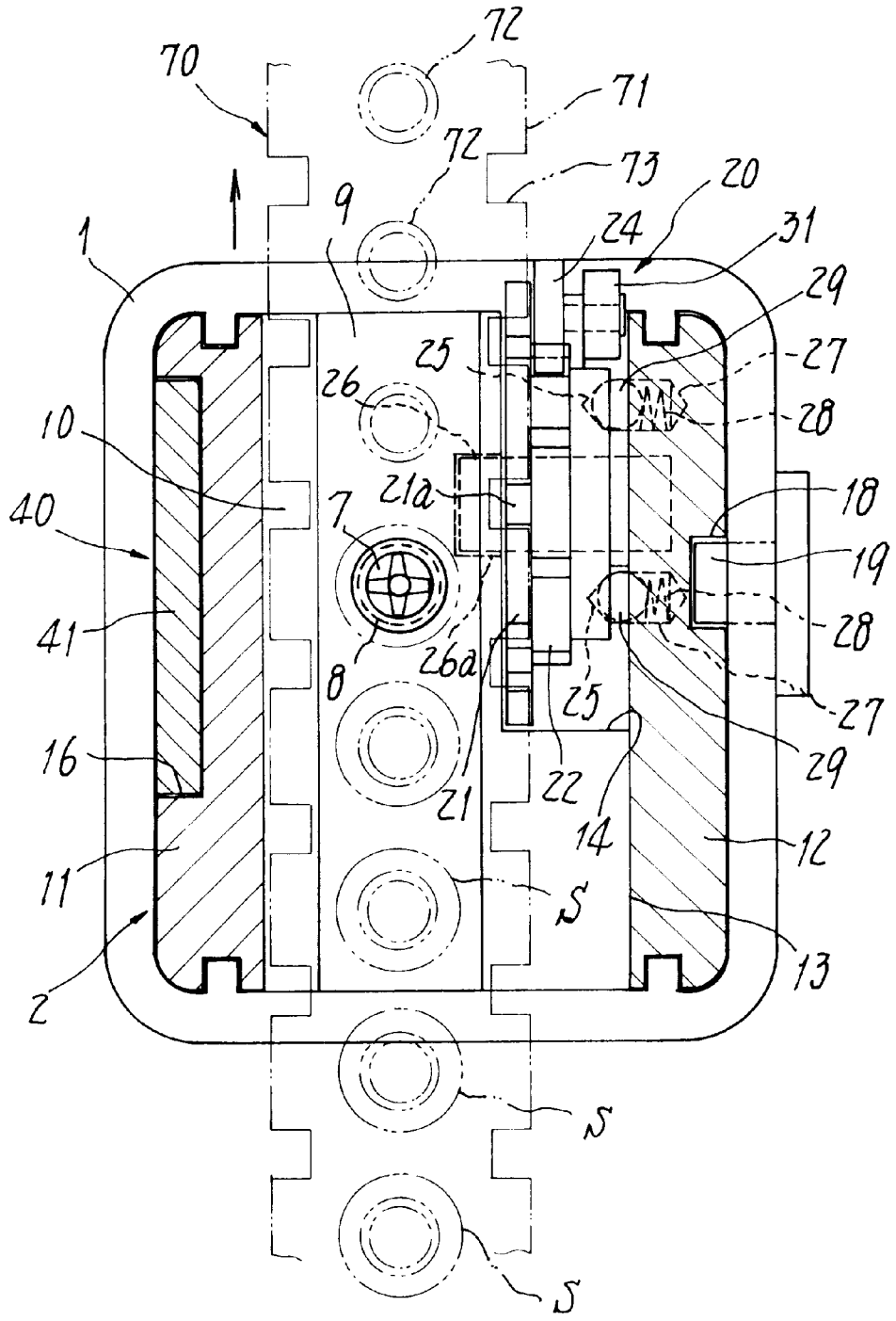
FIG. 5 is an enlarged cross section taken along the line 5—5 in FIG. 2.

As illustrated in FIG. 5, the belt 70 is made of a soft plastics and comprises an elongate body 71. A row of screw-holding low cylinders 72 for holding therein screws 'S' are formed in and along the body 71 at regular intervals (namely at a constant pitch). Cutouts 73 are formed in and along both the lateral sides of the belt body 71 at the same pitch as the low cylinders such that each cutout 73 is located intermediate the two adjacent cylinders 72. A passage 9 is formed in and through a distal end of slider 2 so as to guide the belt 70 'vertically' (in FIG. 1). A belt feeding apparatus 20 built in the slider 2 is of such a structure that the belt 70 will be driven to intermittently advance one pitch by one pitch, whereby the screws 'S' will successively reaches one by one a screw-driving station facing the distal end of the driver bit 7. This mechanism 20 will be detailed hereinafter.

Figure 3:
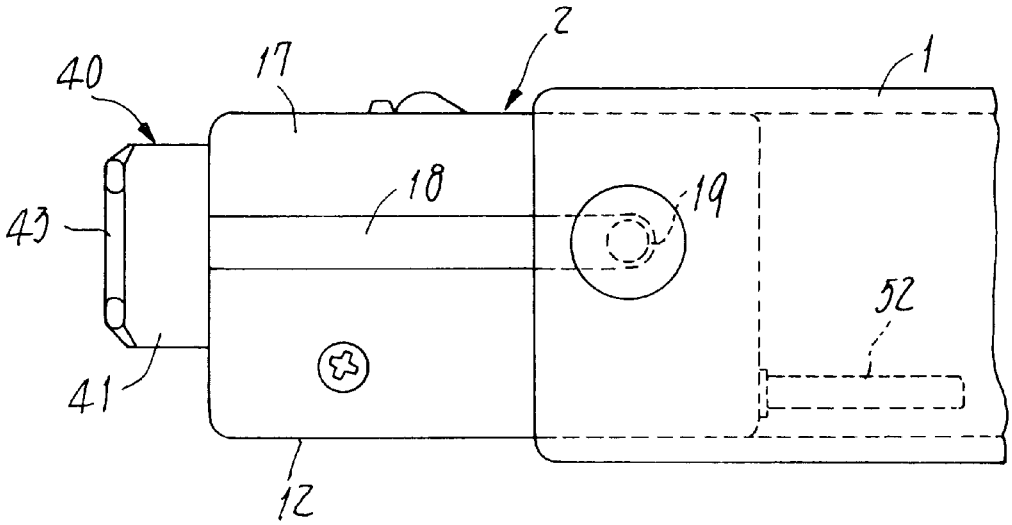
FIG. 3 is a front enlarged elevation of a left-hand part of the apparatus.
Figure 4:
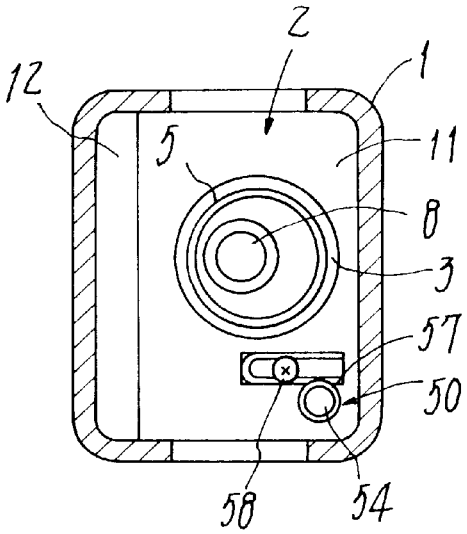
FIG. 4 is a cross section taken along the line 4—4 in FIG. 2.

The slider 2 comprises a main body 11 having a side face 13 to which a lid 12 is secured, and the mechanism 20 outlined above is built in the body 11. Formed in this body are the hole 3 receiving the return spring's end, the small bore 8 for the driver bit, and a first vertical groove 10 defining the passage 8 in part. A cavity 14 formed in an inner side 13 of the main body 11 and facing the lid 12 is for receiving the belt feeding mechanism 20. Formed in and along the main body's outer side 15 opposite to the inner side 13 is a recess 16 (see FIGS. 5 and 6), whereas a channel 18 is formed in an outer face 17 of the lid 12 in a direction in which the casing extends as seen in FIG. 3. The recess 16 receives and displaceably holds an adapter 40 detailed below, with the channel 18 engaging with a pin 19 fixed on the casing so that the slider 2 can reciprocate relative to the casing and between limits which the channel provides. A second vertical groove 10 (see FIG. 2) is formed in the distal end of the lid 12 so that this groove will mate with the first one 10 to define the passage 9 for the screw-carrying belt when the main body 11 is closed with the lid.

The belt feeding mechanism 20 mentioned above is constructed as follows. This mechanism comprises a sprocket 21 for engaging with and intermittently driving the screw-carrying belt 70 one pitch a time, a ratchet wheel 22 disposed coaxially with and causing the sprocket 21 to rotate synchronously, a bell crank 23 cooperating with a pawl 24 to force the ratchet wheel to rotate intermittently. The sprocket 21 and ratchet wheel 22 integral therewith have around their outer peripheries eight teeth 21*a* and eight serrate lugs 22*a*, respectively at a common angular pitch. The ratchet wheel has an outer face in which eight round recesses 25 are formed at the same pitch as those teeth and lugs, and a pair of stopping balls 29 (see FIG. 5) are capable of engaging with any two of the recesses 25 diametrically spaced from each other, so as to temporarily hold still the ratchet wheel. On the other hand, a stud-shaped short shaft 26 fixed to and protruding inwardly from an inner face of the lid 12 does serve as a shaft for rotatably bearing thereon the sprocket 21 and ratchet wheel 22. Two pits 27 formed in the lid's inner face are designed such that the two stopping balls accommodated in the respective pits are always biased outwardly thereof by compression springs 28. A free end of the shaft 26 will fit in a round aperture 26*a* formed in the main body 11 when the lid 12 is secured thereto with setscrews or the like. By assembling the members in this way, the sprocket 21 will be placed in the cavity 14 of the side face 13, together with the ratchet wheel 22. Simultaneously, the balls 29 are set in the recesses 25 to thereby hold the sprocket still at a temporary rest position. The shaft 26 will thus take its position perpendicular to the driver bit 7 extending through the slider 7, and one tooth 21*a* of the sprocket 21 will protrude from the cavity 14 into the lid's one vertical groove 10 defining the passage, so that the sprocket has its part disposed in this passage 9, engaging with one of cutouts 73 that are present along one lateral side of the screw-carrying belt 70.

On the other hand, the bell crank 23 and the pawl 24 will previously be set in the cavity 14 of the side face 13, prior to fixing the lid 12 to the main body 11. The bell crank 23 is pivoted by a pin 30 to the side face 13 so as to be rockably located near the sprocket 21. One end of the bell crank 23 protrudes upward from the main body 11 and has a roller 31 capable of abutting against a stepped shoulder 35 that is formed in the upper wall of said main body. The pawl 24 is pivoted by a further pin 32 to the other end of the bell crank 23. A spring 33 wound on the further pin will always force the pawl's hook 24*a* to be held in mesh with the lugs 22*a* of the ratchet wheel 22. As will be seen in FIG. 2, a recess 34 in the casing's upper wall is of such a shape as providing the stepped shoulder 35 and also as protecting the upwardly protruding sprocket 21 and pawl 24 from unintentionally interfering with the casing 1 when the slider 2 is retracted therein against the return spring 5. However, the shoulder 35 is allowed to push the roller 31 to cause the bell crank 21 to rotate counterclockwise in FIG. 1 around the pivot pin 30. In unison with and as a result of this motion, the pawl 24 will be pulled down to cause one-eighth rotation of the sprocket 21 and ratchet wheel 22. Consequently, the belt 70 will be driven to advance one pitch. After driving one screw into an article, as the return spring 5 pushes the slider 2 to fully protrude again from the casing 1, the spring 33 will make the bell crank 23 and pawl 24 recover their home position shown in FIG. 1. Thus, the hook 24*a* of the pawl will come into engagement with the next lug 22*a* of the ratchet wheel.

Figure 6:
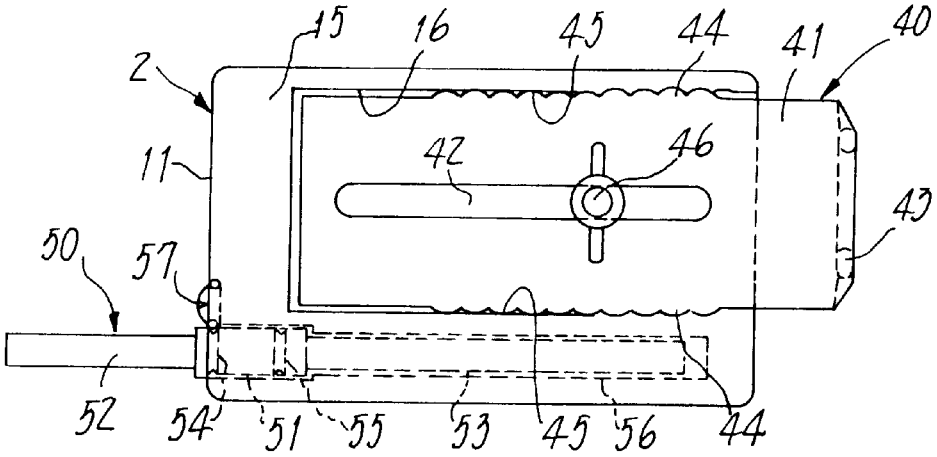
FIG. 6 is a rear elevation of a slider incorporated in the apparatus.

The adapter 40 mentioned above and capable of being changed in position longitudinally of the casing and in response to length of the screws is fitted in the recess 16 of the lid's main body 11. As shown in FIGS. 2 and 6, the adapter 40 consists of a plate 41 having formed therein a longitudinal and elongate aperture 42. A bifurcated extension 43 protrudes from a distal end of the plate 41 such that the adapter is L-shaped as a whole. Indentations 44 formed in and along the lateral sides of the plate 41 are engageable with mating indentations 45 which in turn are formed along side walls of the recess 16. This adapter 40 can thus be adjusted quickly and easily to take any desired position protruding from the distal end of the slider 2. A setscrew 46 may be used to firmly keep the adapter at that position not to rock or undesirably move in any manner.

Figure 8:
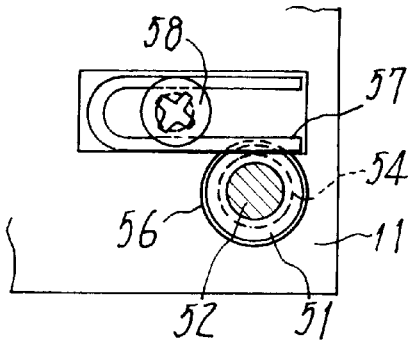
FIG. 8 is a cross section taken along the line 8—8 in FIG. 7.
Figure 7:
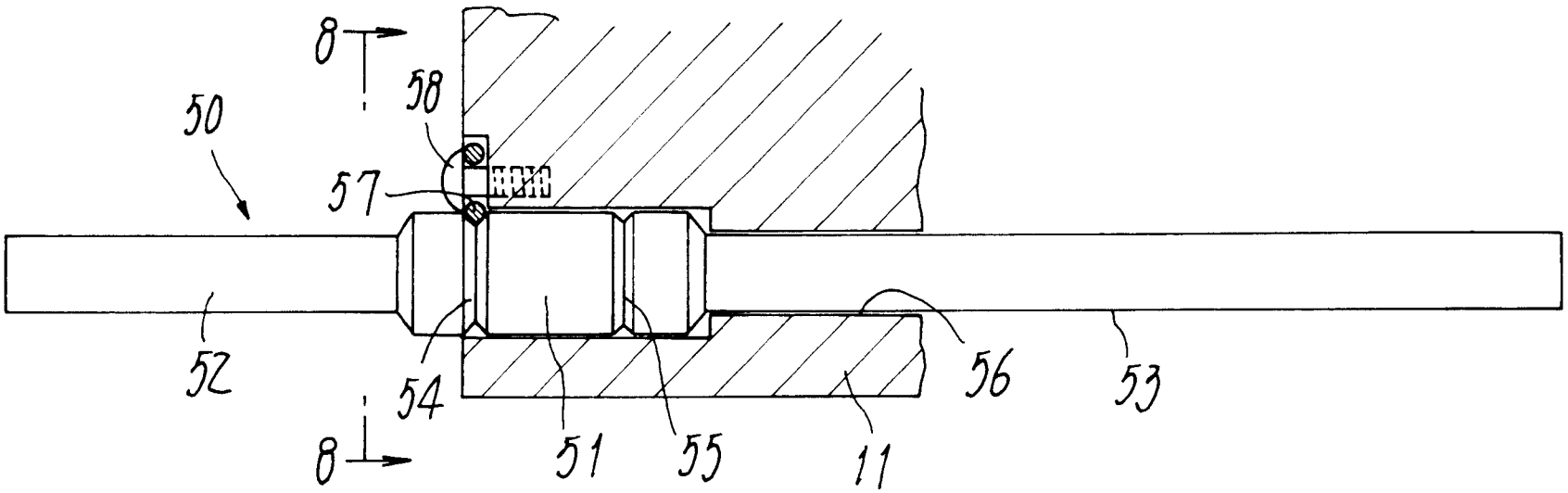
FIG. 7 is an enlarged cross section of the slider shown together with a rod-shaped stopper that is set in place in and through the slider.
Figure 10:
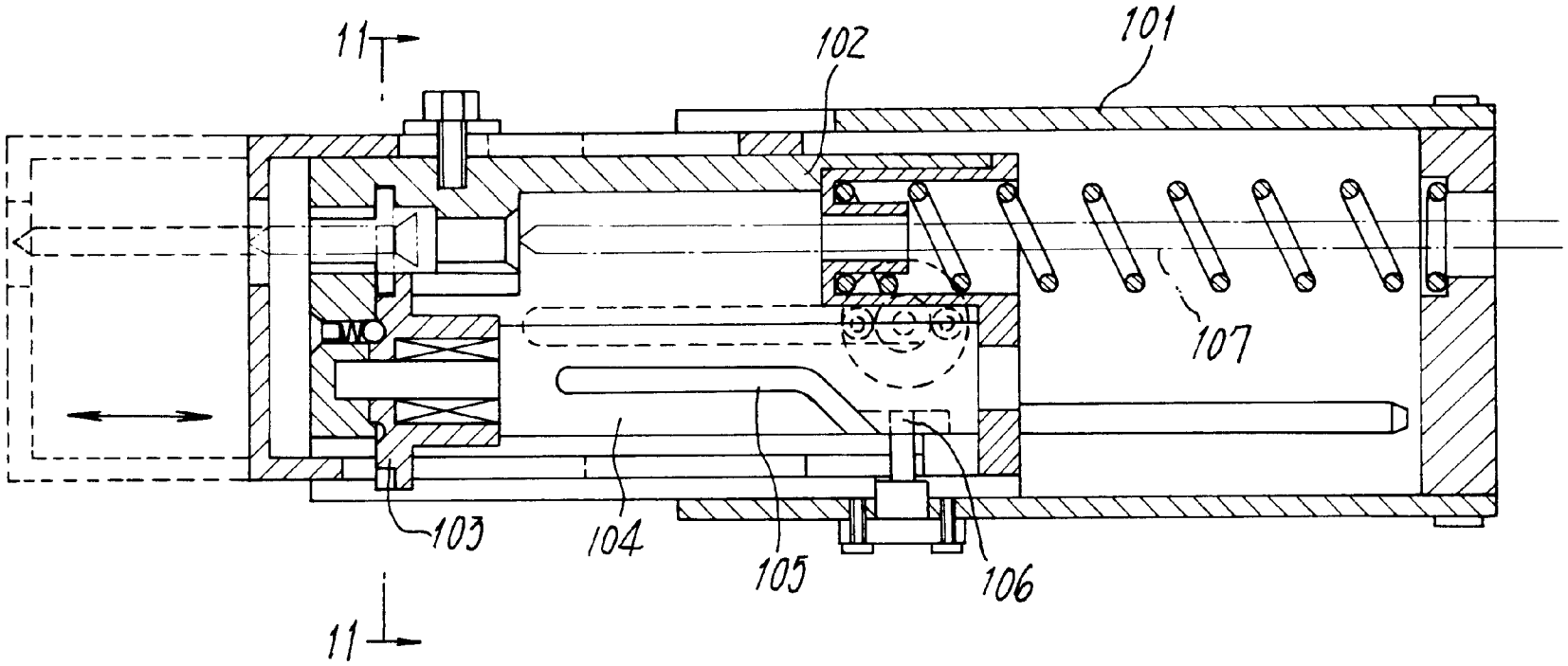
Fig.10 PRIOR ART
FIG. 10 is a vertical cross section of one prior art apparatus.
Figure 11:
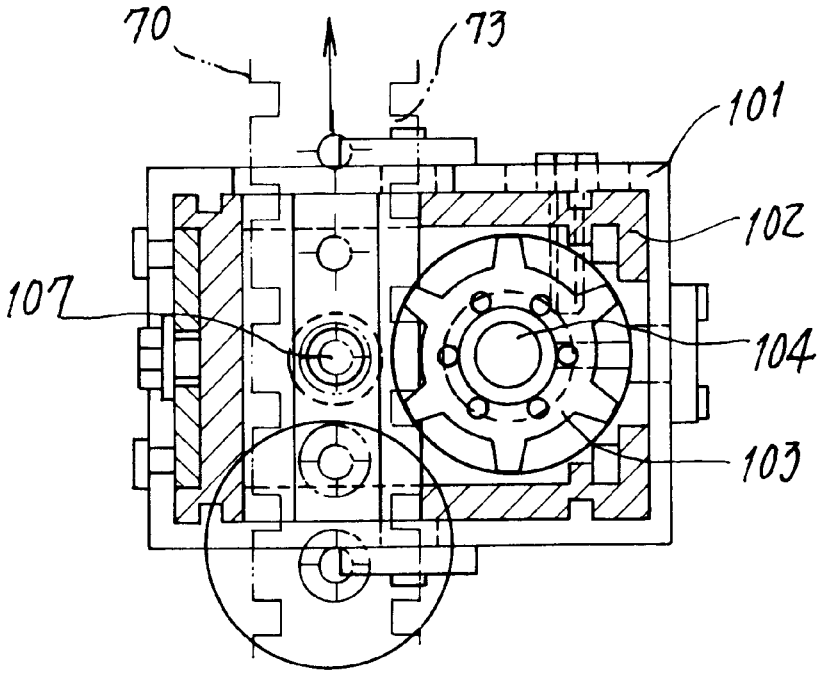
Fig.11 PRIOR ART
FIG. 11 is a cross section taken along the line 11—11 in FIG. 10.

The rod-shaped stopper 50 protruding rearwardly of the proximal end of the slider 2 can be changed in its rearward extension towards the proximal end of the casing 1. Any desired effective stroke of the driver bit 7 for fastening each screw will be realized using this stopper. FIGS. 6 to 8 show the stopper in detail, wherein it consists of a mediate thicker portion 51 and side thinner portions 52 and 53 extending therefrom in opposite directions. One of the thinner portions 52 is shorter than the other 53, and the thickeer portion 51 has two annular grooves 54 and 55 formed in and around its periphery. Although the shorter thin portion 52 takes an operative position in the illustrated example, the longer one 53 may take that position by reversing the stopper 50 'left-side right'. In that example, the longer thin portion 53 rests in a hole 56 extending from near the proximal end to the distal end of the slider's main body 11. A resilient linear member 57 disposed at a proximal opening fits in the outer annular groove 54, so that the shorter side portion 52 of rod-shaped stopper 50 juts rearwardy from the slider's main body 11. The resilient member may be a length of a piano wire bent into a U-shape, with a further setscrew 58 securing it to the proximal end face of the main body in such a state that this member 57 can elastically and temporarily deform itself when the rod 50 is pushed in or pulled out of the hole 56.

In operation, the shorter portion 52 of the described rod will penetrate the casing's lid 4 through an aperture 59 (see FIG. 1) formed therein and then abut against a stopping ring 60, as the slider 2 is retracted deep into the casing 1. This ring 60 is screwed on the round cylinder 6 integral with the lid 4, enabling an operator to readily vary distance between the ring and the lid in response to any change in length of the screws 'S' carried on and by the belt 70. Fine adjustment of the slider's stroke defining depth to which the screws are driven is possible using the ring 60 in this manner, while rough adjustment is possible by selecting either thin portion 52 or 53 of the rod 50. In other words, a reduced distance will suffice for the stopping ring to be regulated in position under any condition. The reference numeral 61 denotes a member for protecting the ring 60 from loosening.

Figure 9:
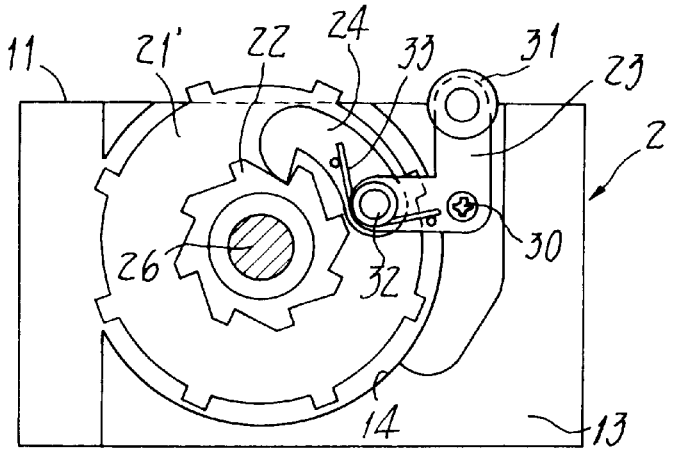
FIG. 9 is a front elevation of the slider modified to build therein an enlarged sprocket.

FIG. 9 shows a case wherein a sprocket 21' of a larger diameter is mounted on the slider 2 so as to match a considerably increased pitch at which the screws are arranged on and carried by the belt 70. It will be seen there that neither main body 11 nor the lid 12 constituting a modified slider 2 need be changed in size. Only the stud-shaped shaft 26 bearing such an enlarged sprocket 21' has to be displaced downwards and a little distance within the modified slider.

It will now be apparent that the single sprocket for intermittently feeding the screw-carrying belt by one pitch every time is mounted on the stud-shaped shaft disposed in the slider's side wall and extending perpendicularly to the driver bit. This feature is advantageous in that the slider can be made small enough for the whole apparatus to be rendered smaller in size and lighter in weight. The shaft for the sprocket need merely be lowered in position if and when an alternative sprocket of a larger diameter is employed, without enlarging the slider, whereby the screw-feeding apparatus of the present invention is rendered more convenient to use.

The mechanism for intermittently rotating the sprocket is of a concise and compact structure, because the bell crank is simply pushed by the casing operated to reciprocate. It is no longer necessary for the slider or casing to have any cam groove or the like.

The embodiment as defined in the accompanying claim 2 will enable the bell crank to operate more smoothly.

The further embodiment defined in the claim 4 the stroke of the slider can readily be adjusted to match the considerably variable length of the screws being used.

What is claimed is:

1. A screw-driving apparatus comprising a cylindrical casing for connection to a distal end of a screw driver, a slider whose proximal region is normally fitted in the casing, the slider having a distal region normally protruding from a distal end of the casing, a return spring always urging the slider towards a normal position thereof, and a belt feeding mechanism that is built in the slider and has a sprocket for causing a screw-carrying belt to move towards a screw-driving station by one pitch every time when the slider is retracted back into the casing against the return spring, wherein screws are arranged on the belt at regular intervals each equal to the pitch, so that the screw having just reached the station is driven by a driver bit of the screw driver into an article, and wherein the sprocket causing the belt to intermittently advance is rotatably held on a transverse shaft that is supported in a side wall of the slider and lying in a direction perpendicular to the driver bit, and the sprocket is driven by a ratchet wheel which is rotated by a pawl swingably connected to a bell crank, the ratchet wheel is coaxial with the sprocket and capable of rotating only in one angular direction in unison with the sprocket, and the bell crank located near the sprocket and terminating short thereof is rockably held on the side wall of the slider so that one arm of the bell crank has an end normally protruding upwards and capable of engaging with a shoulder that is formed in an upper wall of the casing, and the pawl is pivoted to an end of the bell crank's other arm in such a state that a spring means always biases the pawl to engage with a periphery of the ratchet wheel, whereby as the slider is forced back into the casing, the shoulder thereof pushes the one end of the bell crank so that the pawl and the ratchet wheel are activated to make the belt advance intermittently by one pitch.

2. An apparatus as defined in claim 1, further comprising a roller attached to the bell crank's one end normally protruding up from the slider so that the casing's shoulder is allowed to contact said crank at the roller thereof.

3. An apparatus as defined in claim 1 or 2, further comprising a passage for guiding the screw-carrying belt, the passage being formed in and through the distal end of the slider vertically, and an adapter whose position is capable of being changed longitudinally of the casing and in response to length of the screws being used, wherein the adapter is fixed on another side wall opposite to that which bears the belt feeding mechanism so that the adapter is capable of being adjusted to protrude a variable distance from the distal end of the slider, corresponding to the screws' length.

4. An apparatus as defined in claim 1 or 2, further comprising a rod-shaped stopper penetrating the slider and being reversible in position so as to change its rearward extension towards the proximal end of the casing to thereby adjust an effective stroke of the driver bit for fastening each screw.

5. An apparatus as defined in claim 3, further comprising a rod-shaped stopper penetrating the slider and being reversible in position so as to change its rearward extension towards the proximal end of the casing to thereby adjust an effective stroke of the driver bit for fastening each screw.

* * * * *